US005348283A

United States Patent [19]

Yanagi et al.

[11] Patent Number: 5,348,283

[45] Date of Patent: Sep. 20, 1994

[54] SHEET FEEDING APPARATUS HAVING SHEET SEPARATING MEANS WITH ADJUSTABLE FEEDING FORCE

[75] Inventors: Haruyuki Yanagi; Tetsuo Suzuki; Soichi Hiramatsu, all of Yokohama; Takashi Nojima, Tokyo; Satoshi Saikawa, Inagi, all of Japan

[73] Assignee: Canon Kabushiki Kaisha, Tokyo, Japan

[21] Appl. No.: 920,917

[22] Filed: Jul. 28, 1992

[30] Foreign Application Priority Data

Jul. 30, 1991 [JP] Japan ..... 3-190351

[51] Int. Cl.[5] ..... B65H 1/08

[52] U.S. Cl. ..... 271/127; 271/160; 271/170; 271/171

[58] Field of Search ..... 271/160, 170, 171, 248, 271/127

[56] References Cited

U.S. PATENT DOCUMENTS

| | | | |
|---|---|---|---|
| 4,032,136 | 6/1977 | Komaba et al. | 271/160 |
| 4,343,461 | 8/1982 | Tomimori et al. | 271/160 X |
| 4,372,547 | 2/1983 | Yanagawa et al. | 271/160 X |
| 4,582,314 | 4/1986 | Yamamoto et al. | 271/160 X |
| 4,632,380 | 12/1986 | Ono | 271/160 X |
| 4,995,601 | 2/1991 | Ohashi et al. | 271/171 X |

FOREIGN PATENT DOCUMENTS

| | | | |
|---|---|---|---|
| 2223279 | 11/1973 | Fed. Rep. of Germany . | |
| 84736 | 6/1980 | Japan | 271/160 |
| 212327 | 12/1984 | Japan | 271/160 |
| 23034 | 1/1986 | Japan | 271/127 |

OTHER PUBLICATIONS

IBM Technical Disclosure Bulletin, vol. 31, No. 10, pp. 240–242, (Mar., 1989).

*Primary Examiner*—Robert P. Olszewski
*Assistant Examiner*—Boris Milef
*Attorney, Agent, or Firm*—Fitzpatrick, Cella, Harper & Scinto

[57] ABSTRACT

The present invention provides a sheet feeding apparatus including a sheet supporting device for supporting sheets, more than one rotary sheet supply device for feeding out the sheets from the sheet supporting device, a separating device for separating the sheets by regulating a front corner of a sheet to be fed out by the rotary sheet supply device, wherein the rotary sheet supply device closest to the separating device as a greater sheet feeding force than the other rotary sheet supply device.

25 Claims, 11 Drawing Sheets

SHEET FEEDING APPARATUS HAVING SHEET SEPARATING MEANS WITH ADJUSTABLE FEEDING FORCE

BACKGROUND OF THE INVENTION

1. Field of the Invention

The present invention relates to a sheet feeding apparatus for automatically feeding sheets one by one.

2. Related Background Art

Recording systems such as printers, copying machines, facsimiles and the like are so designed that an image comprised of a dot pattern is formed on a recording sheet such as a paper sheet, plastic film and the like by energizing an energy generating means of a recording head in response to inputted image information.

Such recording systems can be grouped into an ink jet recording system, a wire dot recording system, a thermal recording system, an electrophotographic recording system or the like in accordance with recording types. Further, a recording sheet used with the recording system may be a thicker sheet such as a post card, an envelope and the like, a special sheet such as a plastic film or the like, as well as a plain paper sheet. The sheets may be manually inserted one by one or may be automatically and continuously supplied by a sheet feeding apparatus.

FIG. 11 is a perspective view of a conventional recording system B incorporating a sheet feeding apparatus A therein, and FIG. 12 is a perspective view showing a construction of the sheet feeding apparatus A. As shown in FIGS. 11 and 12, the sheet feeding apparatus A generally comprises a sheet supply drive portion constituted by left (L) and right (R) sheet supply rollers 101, 102, a sheet supply roller shaft 106, a drive gear 107 and the like, and a sheet supply cassette portion constituted by left (L) and right (R) side guides 103, 104, a pressure plate 105 and the like and stacking sheets therein. The sheet feeding apparatus is so designed that the sheets are separated and supplied one by one via left (L) and right (R) separating claws 109, 110 by driving the sheet supply rollers 101, 102 by transmitting a driving force from the recording system B to the drive gear 107.

However, in the above-mentioned conventional case, since the sheets were separated by the left and right separating claws, the following drawbacks arose.

(1) To cope with various widths of plural kinds of sheets, since not only the guides but also the separating claws and the sheet supply rollers must be slid bodily on the sheet supply roller shaft, the number of parts is increased, and the apparatus itself is made expensive.

(2) Since the number of parts is increased, it is difficult to save the space effectively, thus making the compactness of the apparatus difficult.

(3) Since the number of parts is increased and the construction becomes complex, is hard to ensure the reliability.

SUMMARY OF THE INVENTION

The present invention aims to eliminate the above-mentioned conventional drawbacks, and an object of the present invention is to provide a sheet feeding apparatus which can reduce the number of parts and make the apparatus small-sized.

To achieve the above object, the present invention provides a sheet feeding apparatus comprising sheet supporting means for supporting sheets, a plurality of rotary sheet supply means for feeding out the sheets from the sheet supporting means, separating means for separating the sheets one by one by regulating only one of front corners of the sheets fed out by the rotary sheet supply means, and feeding force setting means for independently setting sheet feeding forces of the rotary sheet supply means.

Further, the feeding force setting means sets the sheet feeding forces so that the nearer the rotary sheet supply means to the separating means the greater the sheet feeding force.

The setting of the sheet feeding forces can be properly effected by changing the coefficients of friction of the rotary sheet supply means, by changing positions of biasing means for biasing the sheet supply means toward the sheet and/or by setting the different biasing forces of the biasing means with respect to the respective sheet supply means.

With the arrangement as mentioned above, in the case where the sheets are separated by regulating only one of the front corners of the sheets, although it is feared that the sheet is skew-fed due to the resistance generated in the separation of the sheets, it is possible to prevent the skew-feed of the sheet by feeding the sheet with good balance by properly adjusting the feeding forces of the plural sheet supply means. That is to say, by increasing the sheet feeding force near the separating means so that the sheet is fed by the greater feeding force at a side of the sheet subjected to the greater load from the separating means, the left and right forces acting on the sheet are well balanced, thereby preventing the skew-feed of the sheet.

DETAILED DESCRIPTION OF THE PREFERRED EMBODIMENTS

Figure 1:
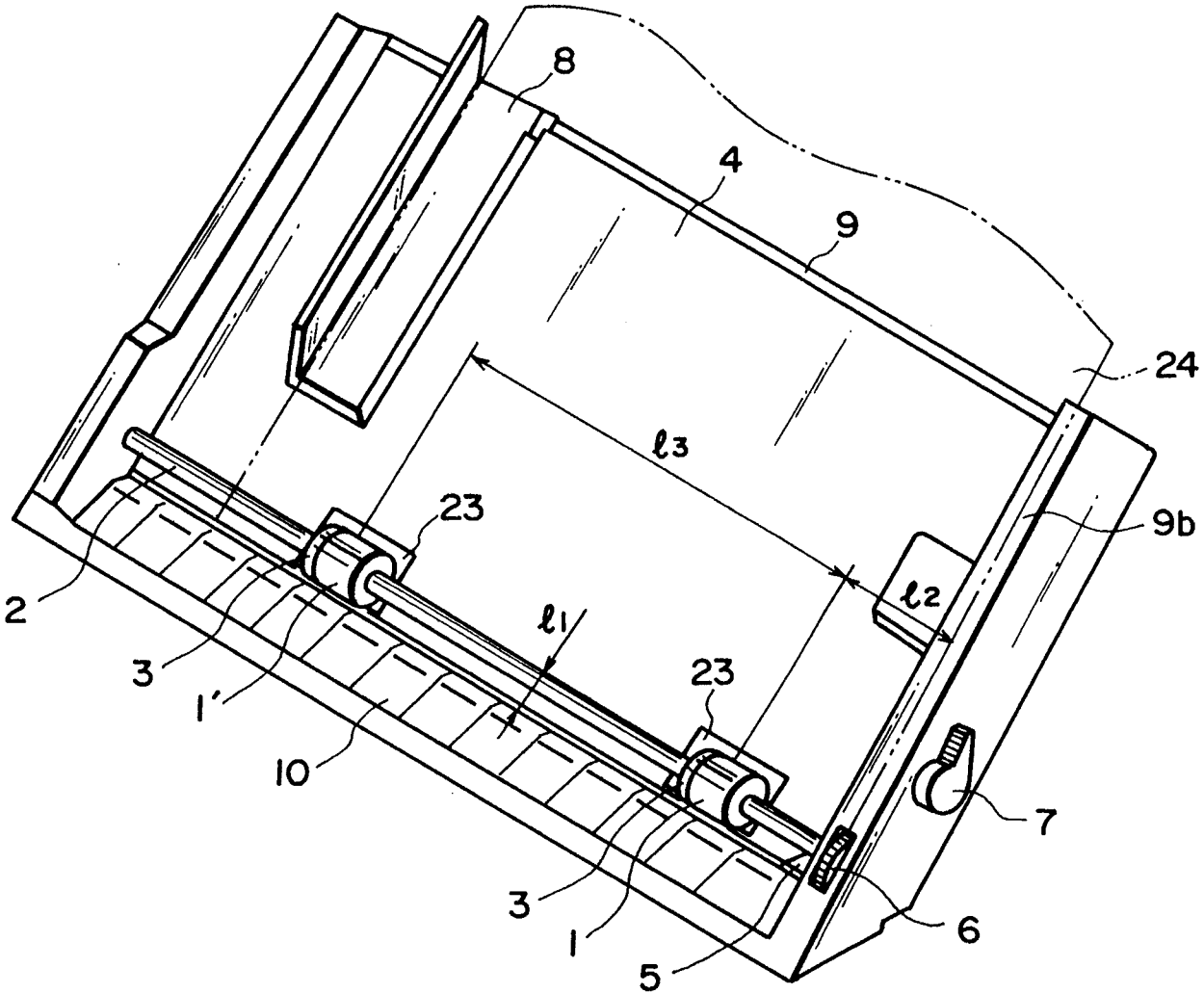
FIG. 1 is a perspective view of a sheet feeding apparatus according to a first embodiment of the present invention.
Figure 2:
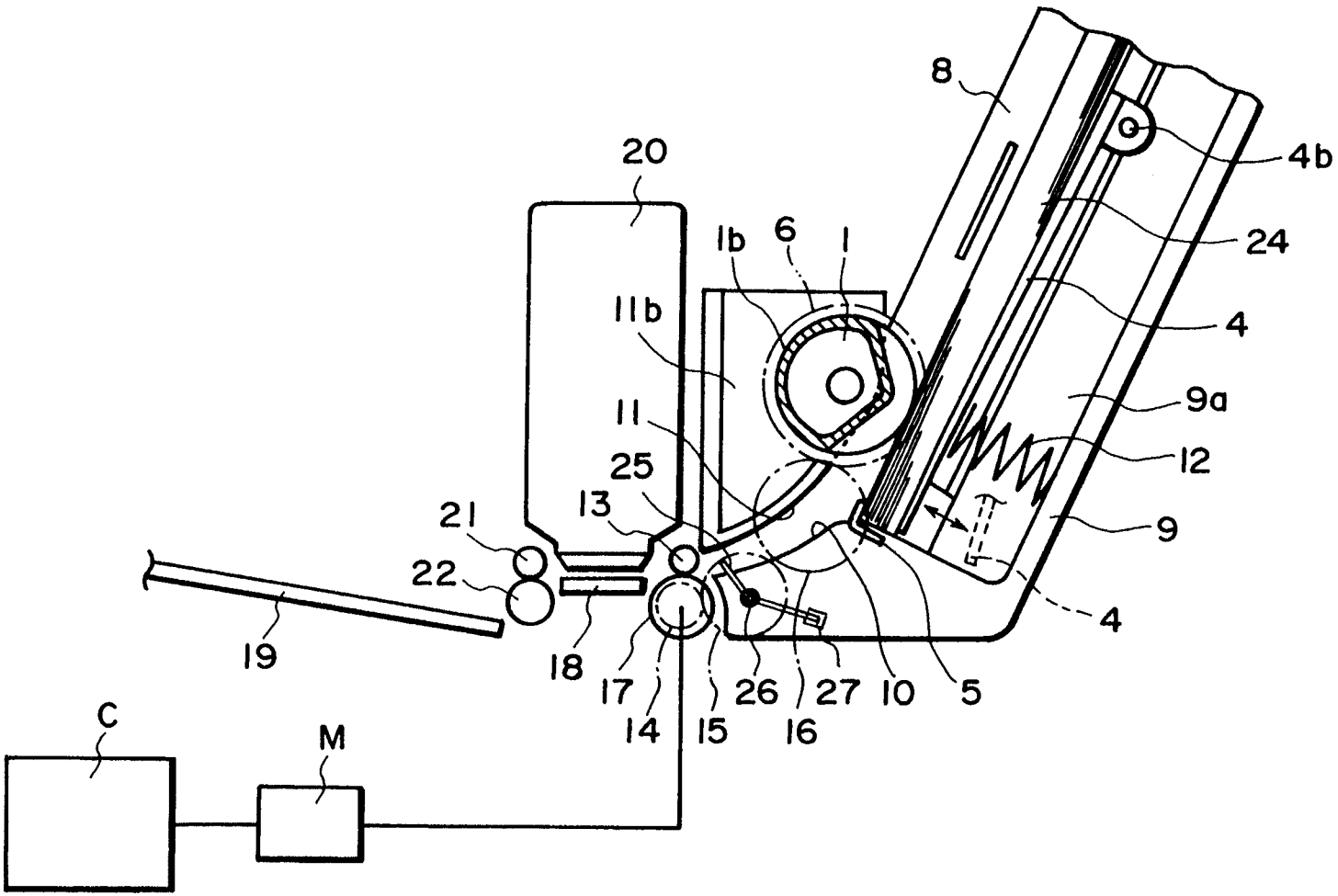
FIG. 2 is a partial elevational sectional view of a recording system incorporating the sheet feeding apparatus of FIG. 1 therein.
Figure 3:
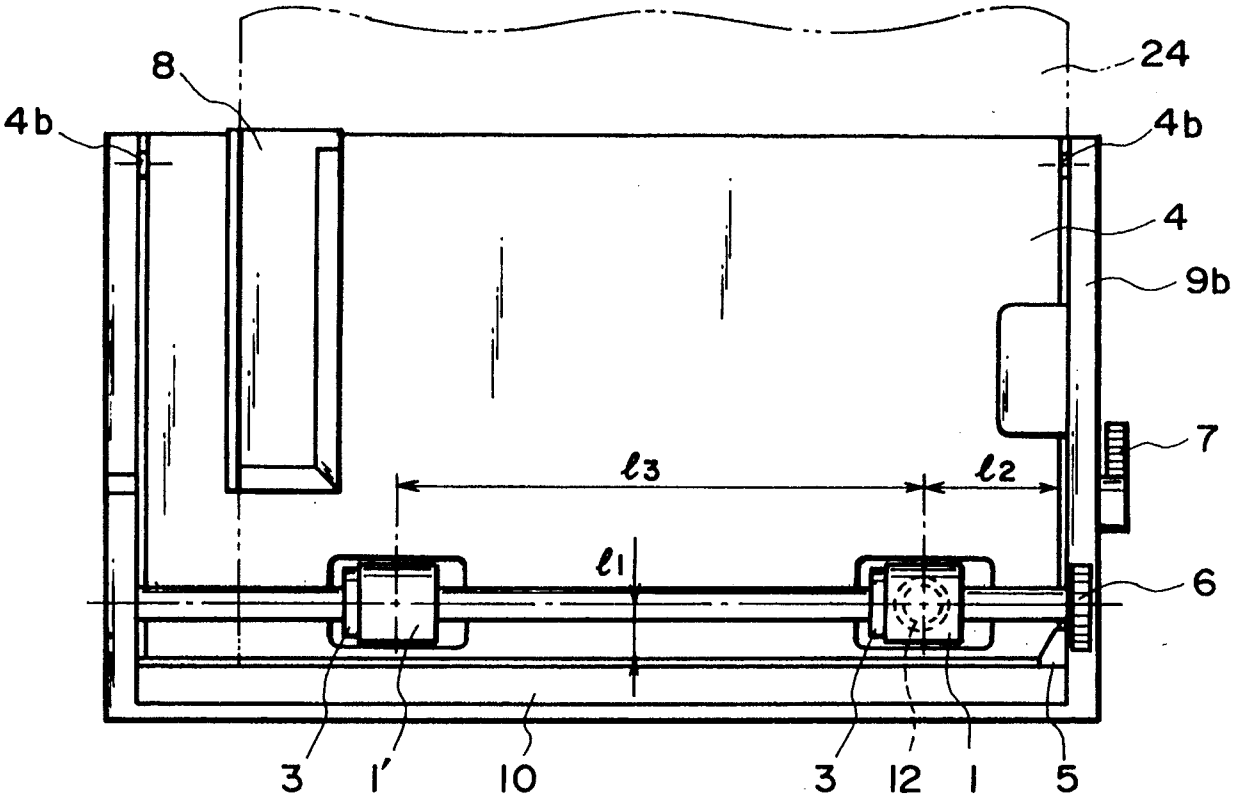
FIG. 3 is a plan view of the sheet feeding apparatus of FIG. 1.

As shown in FIGS. 1 to 3, a sheet feeding apparatus is constituted by a sheet supply drive portion comprising sheet supply rollers 1, 1', a sheet supply roller shaft 2, sheet supply sub-rollers 3, a separating claw 5, a drive gear 6 and a sheet supply cassette portion constituted by a pressure plate 4, a releasing lever 7, a movable side guide 8, a base 9.

First of all, the construction and function of these elements will be briefly described. When the release lever 7 is released, a pressure plate spring 12 is compressed, with the result that the pressure plate 4 is rotated around its pivot pins 4*b* to separate from the sheet supply rollers 1, 1' as shown by the broken line in FIG. 2. In this condition, sheets are rested on the pressure plate so that leading ends of the sheets 24 are abutted against an abutment portion disposed at a downstream side of a lower guide 10. Further, the movable side guide 8 is shifted so that left (in a sheet feeding direction) lateral edges of the sheet 24 are abutted against a left fixed side guide portion 9*b*, thereby setting the sheets 24. In this condition, when the release lever 7 is returned, the pressure plate 4 is pushed up by the pressure plate spring 12 to urge the sheets 24 against the sheet supply rollers 1, 1', thus completing the setting of the sheets.

In a condition that the sheets 24 are set, a driving force of a feed roller 17 can be transmitted to the sheet supply rollers 1, 1' via a gear train comprising four gears 14–16 and drive gear 6. The sheets 24 picked up by the sheet supply rollers 1, 1' are separated one by one by the separating claw 5, and the separated sheet is passed through a space between an upper guide 11 and the lower guide 10 to reach a nip between a rotating pinch roller 13 and feed roller 17. A sensor disposed in front of the nip between these rollers 13, 17 detects the leading end of the sheet 24 to determine a recording start position on the sheet 24. The sheet 24 fed by the paired rollers 13, 17 is advanced along and on a platen 18 of the recording system B, meanwhile an image is recorded on the sheet by a recording head 20 in response to predetermined image information. The recording head 20 is formed integrally with an ink tank to constitute an exchangeable ink jet recording head unit. The recording head 20 is provided with electrical/thermal converters so that the recording is performed by selectively discharging ink from discharge openings of the recording head by utilizing the change in pressure caused by the growth and contraction of bubbles generated by the film boiling produced by thermal energy applied to the selected electrical/thermal converters.

After the predetermined recording is finished, the sheet 24 is ejected onto an ejection tray 19 by an ejector roller 22 and a cooperating spur wheel 21, without deteriorating the image on the sheet 24. Incidentally, a rotation of a drive motor M (FIG. 2) for driving the feed roller is controlled by a control device C provided in the recording system B.

Next, various parts of the sheet feeding apparatus will be fully explained.

The fixed side guide portion 9*b*, lower guide 10 and movable side guide 8 are arranged on the base 9, and the sheets 24 are set by regulating the position of the sheets with respect to references defined by the fixed side guide portion 9*b* and the abutment portion disposed at the downstream side of the lower guide 10, by shifting the movable side guide 8. Further, the base 9 is provided with a recessed portion 9*a* into which the pressure plate 4 can be retarded and within which the pressure plate spring 12 can be disposed in confronting relation to the sheet supply roller 1. The pressure plate 4 is connected to the base 9 via the pivot pins 4*b* disposed at both upper ends of the pressure plate so that the pressure plate can be rotated around the pivot pins 4*b*. Normally, the pressure plate 4 on which the sheets 24 are rested is biased toward the sheet supply rollers 1, 1' by the pressure plate spring 12. When the sheets 24 are exchanged or newly replenished, the release lever 7 is rotated to bring the pressure plate to the retard position shown by the broken line in FIG. 2.

Further, separation pads 23 made of material having relatively great coefficient of friction such as artificial leather are arranged on the pressure plate 4 in confronting relation to the sheet supply rollers 1, 1' to reduce the double-feed of sheets.

As shown in FIGS. 2 and 3, the sheet supply roller shaft 2 is integrally formed with the sheet supply rollers 1, 1', and is connected to the drive gear 6 so that the driving force from the feed roller 17 is transmitted to the sheet supply rollers via the gear train 14, 15, 16, 6. On a peripheral surface of each sheet supply roller 1, 1', there is disposed a sheet supply roller rubber layer 1*b* made of triple copolymer comprising EPDM ethylene, propylene and diene and having a width of about 10–20 mm, and the roller has a D-cut (or semi-cylindrical) configuration. While the sheet supply rollers 1, 1' are rotated by one revolution, only an uppermost sheet 24 is separated from the other sheets by means of the separating claw 5 arranged only at the reference side, and the separated sheet is passed through the space between the upper and lower guides 11, 10 to reach the rotating pinch roller 13 and feed roller 17. In this case, the heading of the sheet 24 is effected by detecting the leading end of the sheet 24 by a sheet sensor lever 25 and a photo-sensor 27. Further, the sheet sensor lever 25 is biased by a sheet sensor spring 26 so that, when there is no sheet, the sheet sensor lever is reset.

The sheet supply sub-rollers 3 are formed from resin material having low sliding resistance and are rotatably mounted on the sheet supply roller shaft 2. Each sheet supply sub-roller 3 has a cylindrical configuration and has a diameter smaller than a diameter of the cylindrical portion of each sheet supply roller 1, 1' and greater than a diameter of the cutout portion of each sheet supply roller. Thus, after being disenergized, if the cylindrical portions of the sheet supply rollers 1, 1' are contacted with the sheet 24, the sheet supply rollers are rotatingly driven by the movement of the sheet, while, if the cutout portions of the sheet supply rollers are faced to the sheet 24, only the sheet supply sub-rollers 3 are contacted with the sheet, with the result that only the sheet supply sub-rollers 3 are rotatingly driven by the movement of the sheet but the sheet supply rollers 1, 1' are held at predetermined positions. In this way, during the recording operation, it is possible to always maintain the initial position of the sheet supply rollers 1, 1'.

In case of the sheets having the maximum recordable width of A3–A4 (longitudinal), in order to supply the sheet properly without occurring the skew-feed of the sheet, the sheet supply rollers 1, 1' are arranged in such a manner that a distance $l_1$ between the leading end of the sheet 24 and a center of each roller becomes 10–30 mm ($l_1$=10–30 mm), a distance $l_2$ between the side reference and the center of the nearer roller 1 becomes 20–50 mm ($l_2$=20–50 mm), and a distance ($l_2+l_3$) between the side reference and the other roller 1' becomes 100–200 mm ($l_2+l_3$=100–200 mm). In this regard, for the sheets having the maximum recordable width of A3–A4 (longitudinal), if only the sheet supply roller 1 is provided near the separating claw 5, the left and right balances will be worsened, thereby causing the skew-feed of the sheet. Thus, the other sheet supply roller 1' is required. However, for the sheets having the maximum recordable width of B5 (longitudinal) or less, in accordance with the position $l_1$ of the sheet supply roller 1 and the configuration of the guide, it is possible to feed the sheet effectively without the skew-feed only by the sheet supply roller 1. Accordingly, the position of the sheet supply roller 1' is determined properly as the distance $l_2+l_3$ =100–200 mm. Incidentally, although the sheet supply rollers 1, 1' are integrally formed with the sheet supply roller shaft 2 and the distances $l_1$, $l_2$, $l_3$ are fixed, it is possible to cope with many a plurality kinds of sheets. In this case, the sheet 24 is set and regulated by shifting the movable side guide 8 to the right or left.

Further, in the illustrated embodiment, the pressure plate spring 12 is disposed directly below the sheet supply roller 1 near the separating claw 5. The force of this pressure plate spring 12 acting on the pressure plate 4 is set to have a value of about 100–300 grams within the movable range of the pressure plate 4. In this case, since the pressure plate 4 and its pivot pins **4*b* are not rigid bodies but have elasticity, for example, the load of the pressure plate 4 acting on the sheet supply roller 1 becomes about 70–200 grams while the load of the pressure plate acting on the other sheet supply roller 1' becomes about 30–100 grams, so that the load on the sheet supply roller 1 is always greater than that on the other sheet supply roller. Thus, in the left and right sheet supply rollers 1', 1, the sheet feeding force of the sheet supply roller 1 near the separating claw 5 becomes greater than that of the other sheet supply roller 1'. The separating claw 5 is arranged only at one side and this separating claw 5 applies the resistance to the sheet in the feeding of the sheet. However, by increasing the sheet feeding force of the sheet supply roller 1 near the separating claw 5 more than that of the other sheet supply roller 1'**, the left and right balances are improved, whereby the sheet can be separated effectively by the separating claw and be properly fed without any skew-feed of the sheet.

Further, since the pressure plate spring 12 is arranged directly below the sheet supply roller 1, it is possible to eliminate the deformation of the pressure plate 4 when the sheet 24 are rested on the pressure plate 4. In addition, since only one pressure plate spring 12 is used, the number of parts is reduced to make the apparatus inexpensive, and the space below the pressure plate can be utilized effectively, thus making the apparatus more compact.

Next, a second embodiment of the present invention will be explained.

Figure 4:
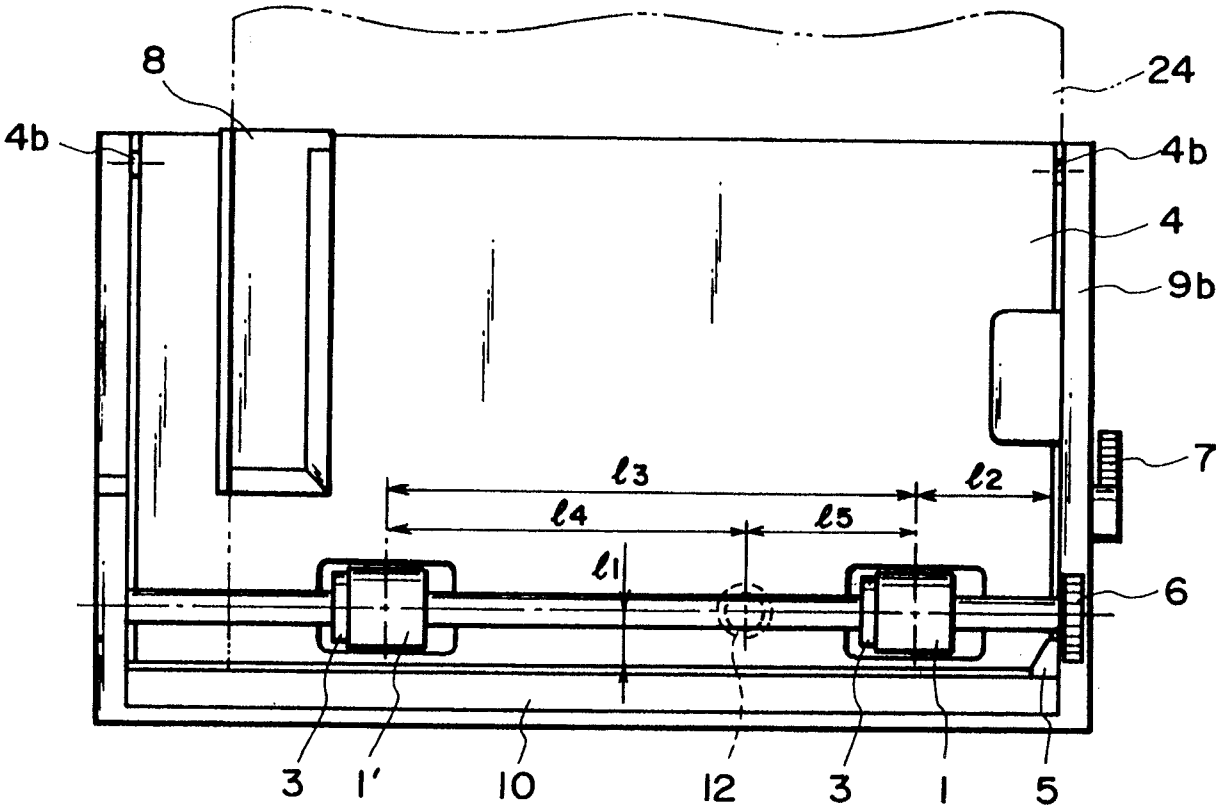
FIG. 4 is a plan view of a sheet feeding apparatus according to a second embodiment of the present invention.

In the above-mentioned first embodiment, while the pressure plate spring 12 was disposed directly below the sheet supply roller 1 near the separating claw 5, as shown in FIG. 4, the pressure plate spring 12 may be arranged between the sheet supply rollers 1, 1' below them.

When the positions of the sheet supply rollers 1, 1' and the force of the pressure plate spring 12 are assumed to be the same as those in the first embodiment, the position of the pressure plate spring 12 can be properly found on the sheet supply roller shaft 2 with a relation $l_4>l_5$. For example, when the position of the pressure plate spring is set to have a relation $l_4 \simeq 2l_5$, the load of the pressure plate 4 acting on the sheet supply roller 1 becomes about 60–200 grams while the pressure plate acting on the sheet supply roller 1' becomes about 40–120 grams, so that the load on the sheet supply roller 1 is always greater than that on the other sheet supply roller. Accordingly, the sheet feeding force of the sheet supply roller 1 also becomes greater than that of the other sheet supply roller, thereby providing the well balanced feeding mechanism in consideration of the resistance of the separating claw 5 in the separation of the sheet.

In this second embodiment, the ratio between the loads on the sheet supply rollers 1 and 1' from the pressure plate 4 can be reduced (the load ratio to the sheet supply roller 1' becomes greater) in comparison with the first embodiment. Further, since the proper position of the pressure plate spring can be obtained by changing the distances, $l_4$, $l_5$, the degree of the freedom in the design is further increased. The other arrangements are the same as those in the first embodiment.

Next, a third embodiment of the present invention will be explained.

Figure 5:
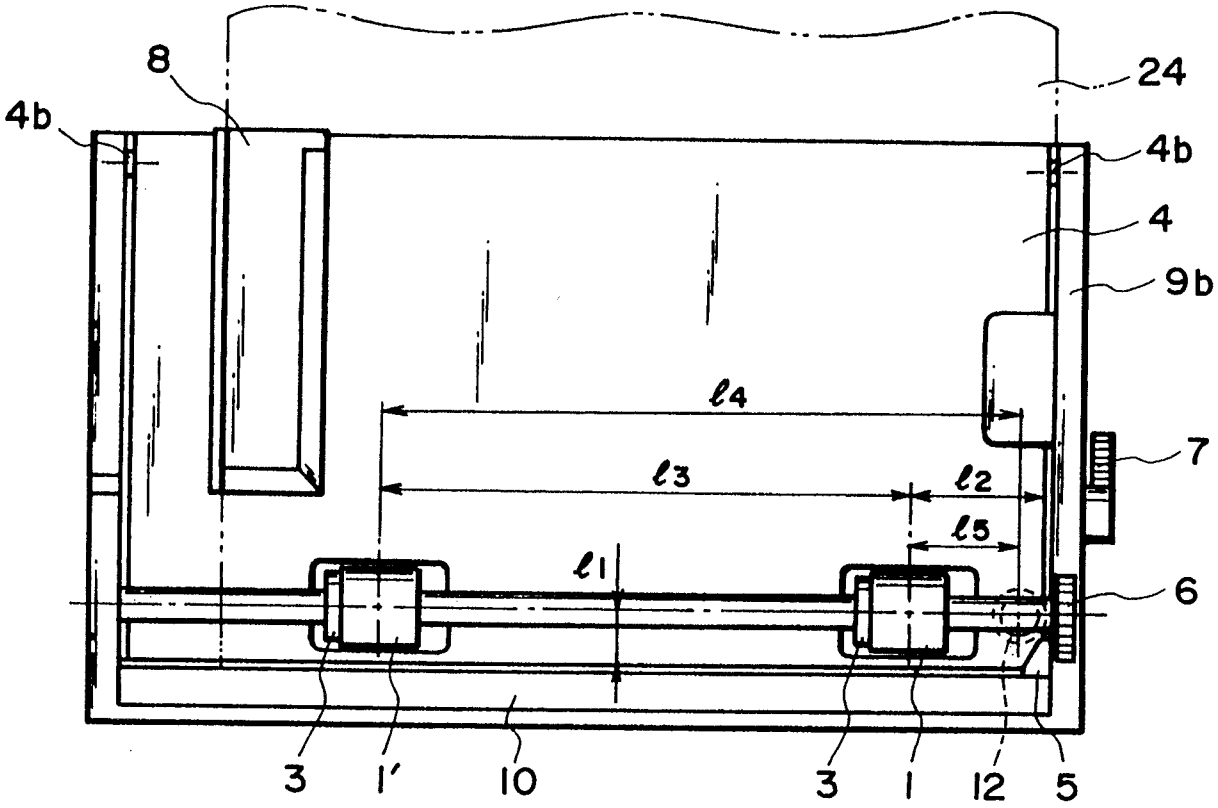
FIG. 5 ms a plan view of a sheet feeding apparatus according to a third embodiment of the present invention.

In the above-mentioned first and second embodiments, while the pressure plate spring 12 was arranged directly below the sheet supply roller 1 near the separating claw 5 or arranged between the sheet supply rollers 1 and 1' near the former, as shown in FIG. 5, the pressure plate spring 12 may be arranged between the sheet supply rollers 1 and the separating claw 5.

When the positions of the sheet supply rollers 1, 1' and the force of the pressure plate spring 12 are assumed to be the same as those in the first and second embodiment, for example, the position of the pressure plate spring 12 can be properly found at the distances $l_5$=10–40 mm, $l_4$=100–180 mm. In this case, the load of the pressure plate 4 acting on the sheet supply roller 1 becomes about 80–250 grams while the pressure plate acting on the sheet supply roller 1' becomes about 20–60 grams, so that the load on the sheet supply roller 1 near the separating claw 5 is always greater than that on the other sheet supply roller. Accordingly, the sheet feeding force of the sheet supply roller 1 also becomes greater than that of the other sheet supply roller, thereby providing the well balanced feeding mechanism in consideration of the resistance of the separating claw 5 in the separation of the sheet, as in the aforementioned embodiments.

In this third embodiment, the ratio between the loads on the sheet supply rollers 1 and 1' from the pressure plate 4 can be further reduced (the load ratio to the sheet supply roller 1' becomes greater) in comparison with the first and second embodiments. Further, since the proper position of the pressure plate spring can be obtained by changing the distances, $l_4$, $l_5$, the degree of the freedom in the design is further increased. In addition, when the pressure plate 4 is released by depressing the plate only at its one side by the release lever 7 in order to make the apparatus inexpensive and small-sized, even if the pressure plate 4 has less rigidity, it is possible to reduce the lateral inclination of the plate.

The other arrangements are the same as those in the first and second embodiments.

Next, a fourth embodiment of the present invention will be explained.

Figure 6:
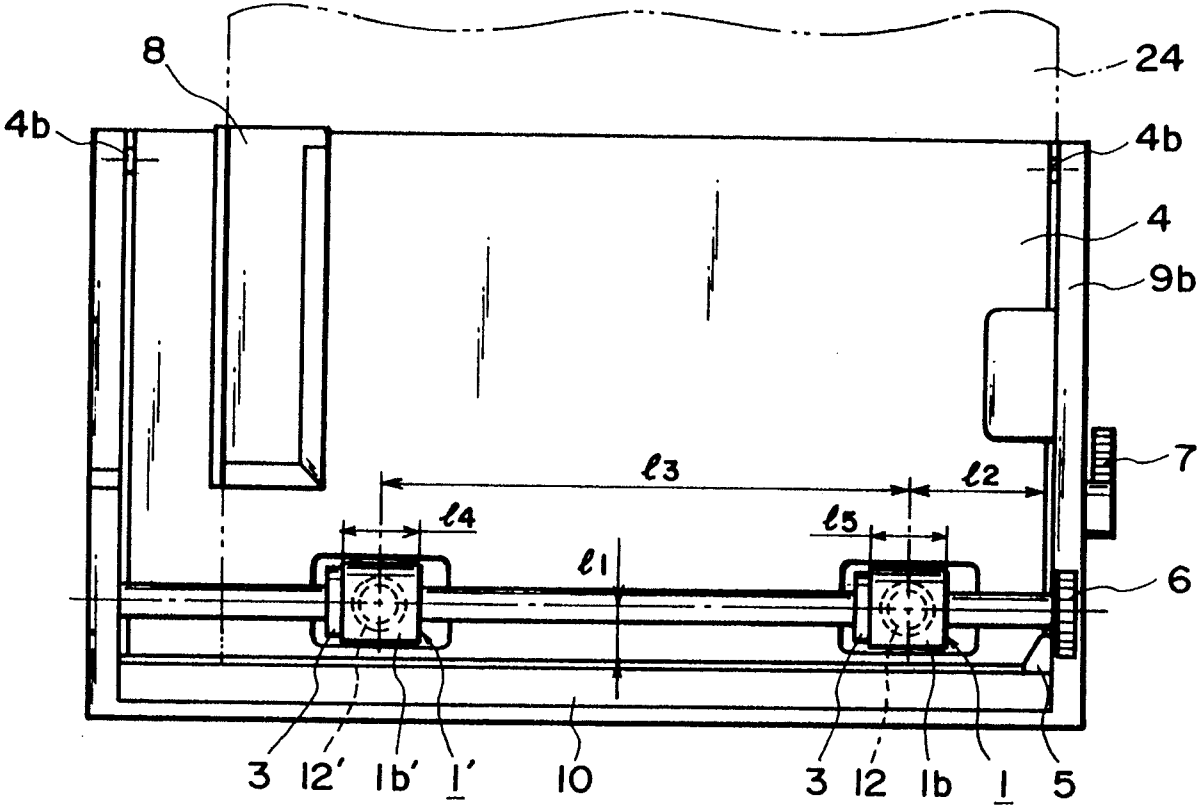
FIG. 6 ms a plan view of a sheet feeding apparatus according to a fourth embodiment of the present invention.

In the above-mentioned first to third embodiments, while the feeding forces of the sheet supply rollers 1, 1' for feeding the sheet 24 were differentiated by changing the loads acting on the sheet supply rollers 1, 1' by appropriately selecting the positions of the single pressure plate spring 12, as shown in FIG. 6, two substantially identical pressure plate springs 12, 12' may be used. In this case, the sheet feeding forces of the sheet supply rollers 1, 1' can be differentiated by changing widths of the sheet supply rollers 1, 1'. For example, a width $l_4$ of the sheet supply roller 1' is smaller than a width $l_5$ of the sheet supply roller 1, and, by setting the widths to have relations $l_4=5$–15 mm and $l_5=10$–25 mm, the well balanced feeding mechanism can be provided in consideration of the resistance of the separating claw 5 in the separation of the sheet.

In this embodiment, since the portions of the pressure plate 4 urged by the pressure plate springs 12, 12' are supported by the sheet supply rollers 1, 1', the deformation of the pressure plate 4 is minimized. The other arrangements are the same as those in the first to third embodiments.

Next, a fifth embodiment of the present invention will be explained.

Figure 7:
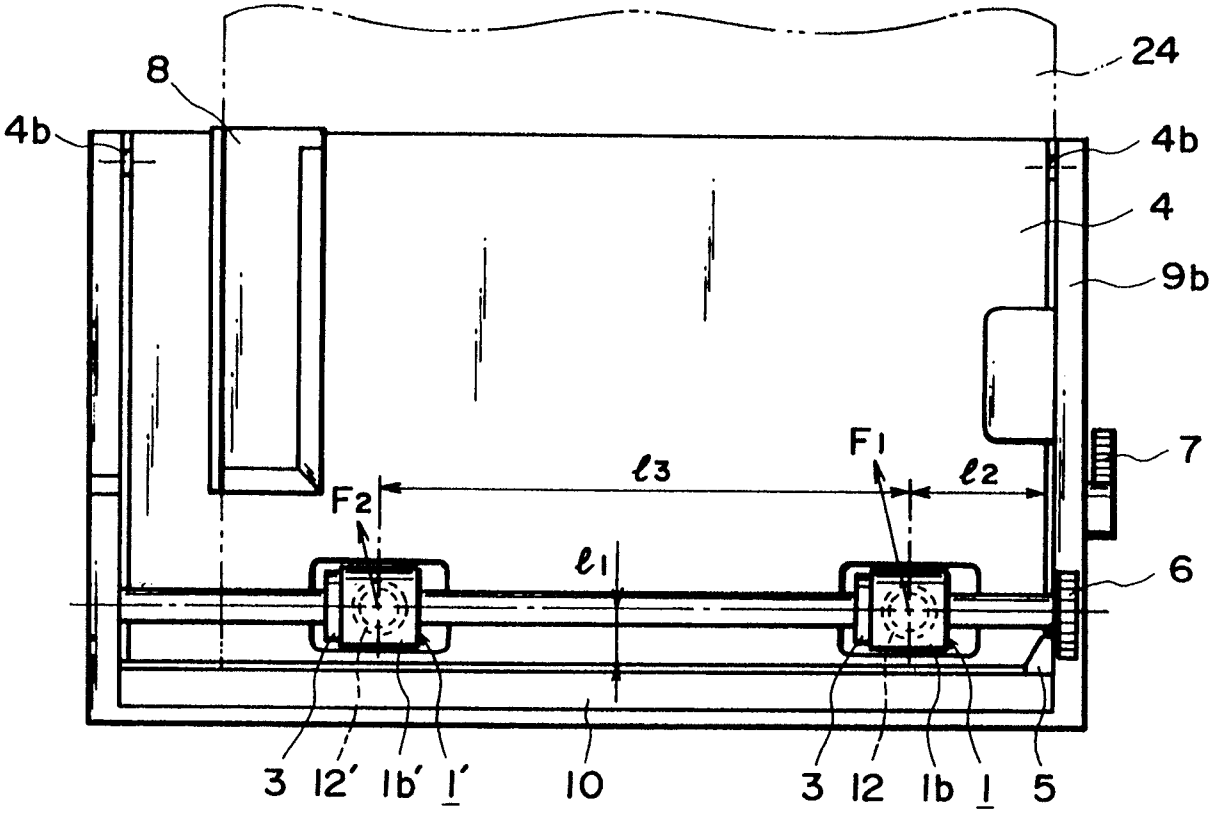
FIG. 7 ms a plan view of a sheet feeding apparatus according to a fifth embodiment of the present invention.

In the above-mentioned first to third embodiments, while the feeding forces of the sheet supply rollers 1, 1' for feeding the sheet 24 were differentiated by changing the loads acting on the sheet supply rollers 1, 1' by appropriately selecting the positions of the single pressure plate spring 12, as shown in FIG. 7, two pressure plate springs 12, 12' may be arranged directly below the sheet supply rollers 1, 1', respectively, and the sheet feeding forces of the sheet supply rollers 1, 1' may be differentiated by changing the forces of these springs. By selecting the force $F_1$ of the pressure plate spring 12 to become greater than the force $F_2$ of the pressure plate spring 12' ($F_1>F_2$) and by setting the forces to $F_1=70$–200 grams and $F_2=30$–100 grams, the well balanced feeding mechanism can be provided in consideration of the resistance of the separating claw 5 in the separation of the sheet.

In this embodiment, since the portions of the pressure plate 4 urged by the pressure plate springs 12, 12' are supported by the sheet supply rollers 1, 1' the deformation of the pressure plate 4 is minimized. The other arrangements are the same as those in the aforementioned embodiments.

Next, a sixth embodiment of the present invention will be explained.

Figure 8:
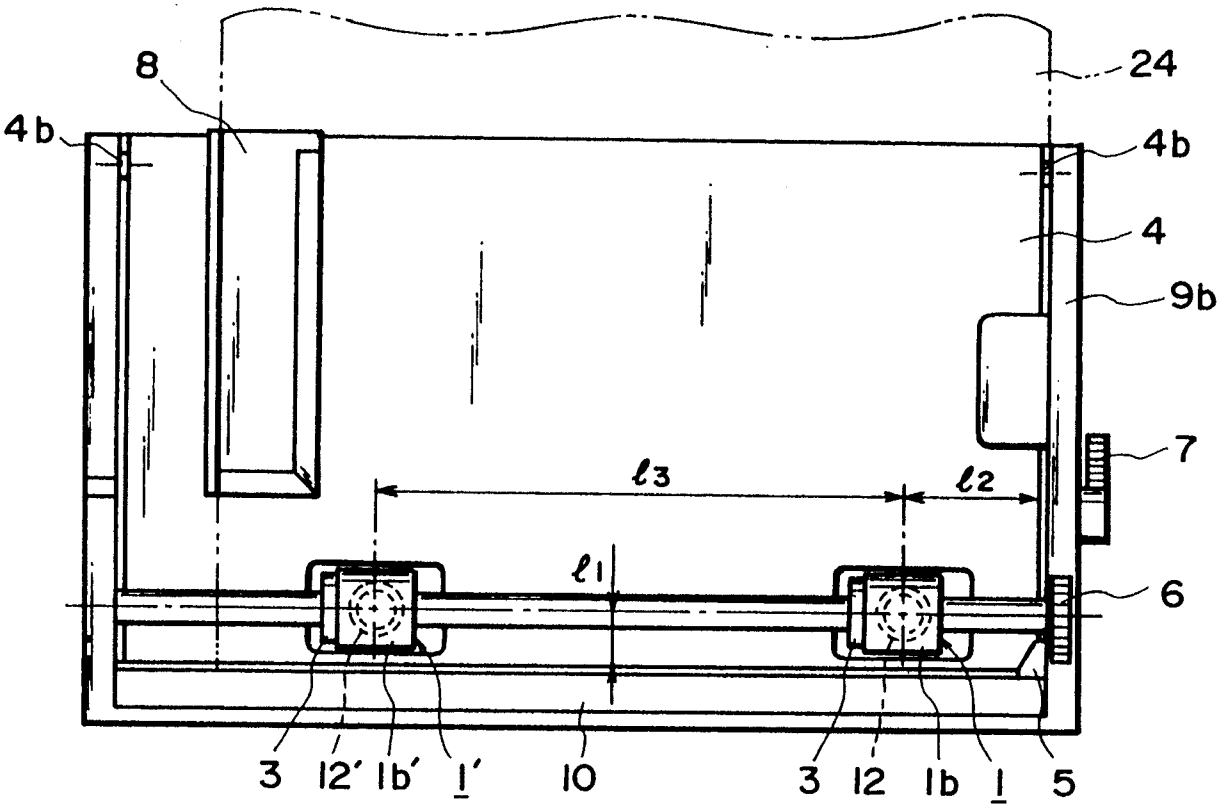
FIG. 8 ms a plan view of a sheet feeding apparatus according to a sixth embodiment of the present invention.

In this embodiment, the sheet feeding forces of the sheet supply rollers 1, 1' are determined by coefficients of friction between the sheet 24 on the pressure plate 4 biased by the pressure plate springs 12, 12' and the sheet supply rollers 1, 1'. In this embodiment, as shown in FIG. 8, the spring forces of the pressure plate springs 12, 12' acting on the pressure plate 4 are equal, and are set to have a value of 100–300 grams within the movable range of the pressure plate.

Sheet supply roller rubber layers **1*b*, 1*b'* are provided on surfaces of the sheet supply rollers 1, 1' facing the sheet 24 so that the sheet supply roller rubber layers contact with the sheet 24 to feed the latter. The sheet supply roller rubber layers 1*b*, 1*b'* are made of rubber material such as EPDM (triple copolymer consisting of ethylene, propylene and diene), and a hardness of the sheet supply roller rubber layer 1*b* on the sheet supply roller 1 near the separating claw 5 is selected to have a value greater than a hardness of the other sheet supply roller rubber layer 1*b'*. For example, when it is so selected that the hardness of the sheet supply roller rubber layer 1*b* becomes 30–50° and the hardness of the sheet supply roller rubber layer 1*b'* becomes 40–60°, the coefficients of friction between these rubber layers and the high class paper sheet become about 2.5–2.0 and about 2.2–1.5, respectively, so that the coefficient of friction between the sheet and the sheet supply roller 1 is always greater than that between the sheet and the other sheet supply roller. Thus, in the left and right sheet supply rollers 1', 1, the sheet feeding force of the sheet supply roller 1 near the separating claw 5 becomes greater than that of the other sheet supply roller 1'**.

The separating claw 5 is arranged only at one side and this separating claw 5 applies the resistance to the sheet in the feeding of the sheet. However, by increasing the sheet feeding force of the sheet supply roller 1 near the separating claw 5 greater than that of the other sheet supply roller 1' as mentioned above, the left and right balances are improved, whereby the sheet can be separated effectively by the separating claw and be properly fed without any skew-feed of the sheet.

Next, a seventh embodiment of the present invention will be explained.

Figure 9:
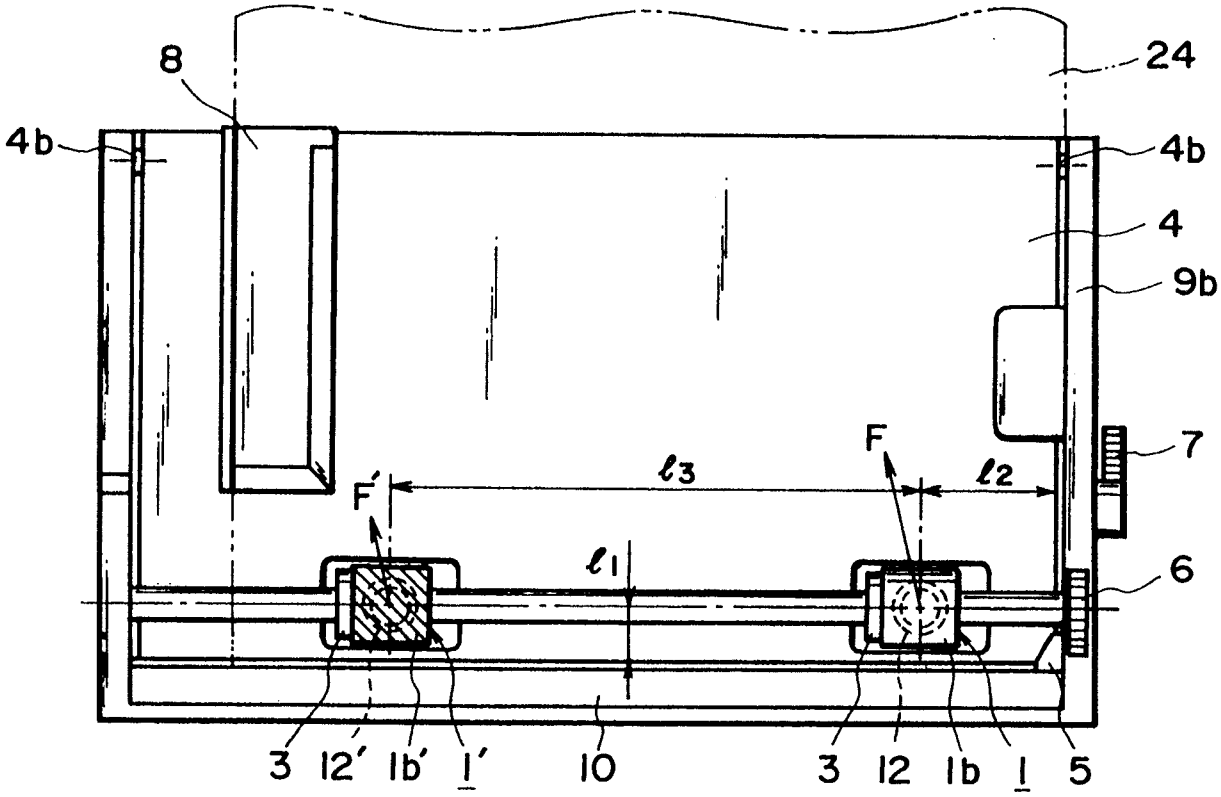
FIG. 9 is a plan view of a sheet feeding apparatus according to a seventh embodiment of the present invention.

In the above sixth embodiment, while the sheet feeding forces of the sheet supply rollers 1, 1' for the sheet 24 were differentiated by changing the coefficients of friction due to the difference in hardness between the sheet supply roller rubber layers **1*b*, 1*b'*, as shown in FIG. 9, the coefficients of friction may be differentiated by changing the rubber materials forming the sheet supply roller rubber layers 1*b*, 1*b'***.

For example, the sheet supply roller rubber layer **1*b* can be made of EPDM and the sheet supply roller rubber layer 1*b'* can be made of IR (isoprene rubber) or NBR (nitrile rubber) which has the coefficient of friction smaller than that of EPDM. In this case, when the hardness values of these rubber layers are substantially the same and are 40–60°, the coefficient of friction between the rubber layer made of EPDM and the high class paper sheet becomes about 2.2–1.5and the coefficient of friction between the rubber layer made of IR or NBR and the high class paper sheet becomes about 1.8–1.2. Thus, it is possible to increase the coefficient of friction of the sheet supply roller rubber layer 1*b* so that it is greater than that of the sheet supply roller rubber layer 1*b'***.

Further, the loads F, F' of the pressure plate 4 acting on the sheet supply rollers 1, 1' can be differentiated by changing the forces of the pressure plate springs 12, 12'. The combination of this difference in the loads and the above-mentioned difference in the coefficients of friction, it is possible to increase the feeding force of the sheet supply roller 1 for the sheet 24 greater than that of the sheet supply roller 1'.

As mentioned above, since the coefficients of friction can be differentiated by changing the rubber materials forming the sheet supply roller rubber layers **1*b*, 1*b'*, it is possible to improve the degree of freedom in design and manufacture, for example, in the point that the rubber materials having the desired hardness and suitable for the material of the rollers can be used. Further, by combining this with the difference in the loads on the sheet supply rollers 1, 1' due to the pressure plate springs 12, 12'**, the degree of freedom can be further improved. The other arrangements are the same as those in the aforementioned embodiments.

Lastly, an eighth embodiment of the present invention will be explained.

Figure 10:
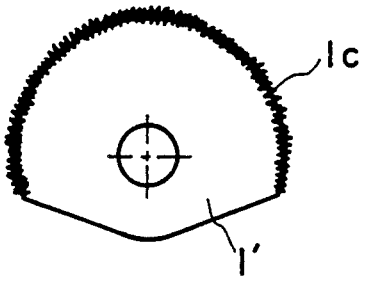
FIG. 10 is a side view of a sheet supply roller used with a sheet feeding apparatus according to an eighth embodiment of the present invention.
Figure 11:
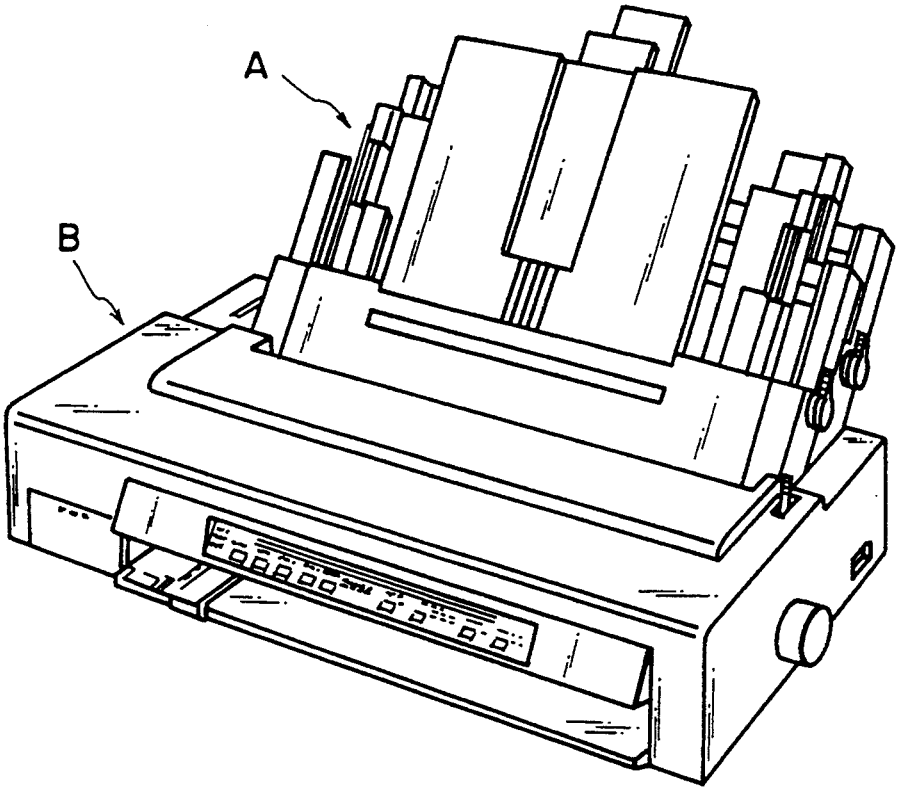
FIG. 11 PRIOR ART
FIG. 11 is a perspective view of a conventional recording system incorporating a sheet feeding apparatus therein.
Figure 12:
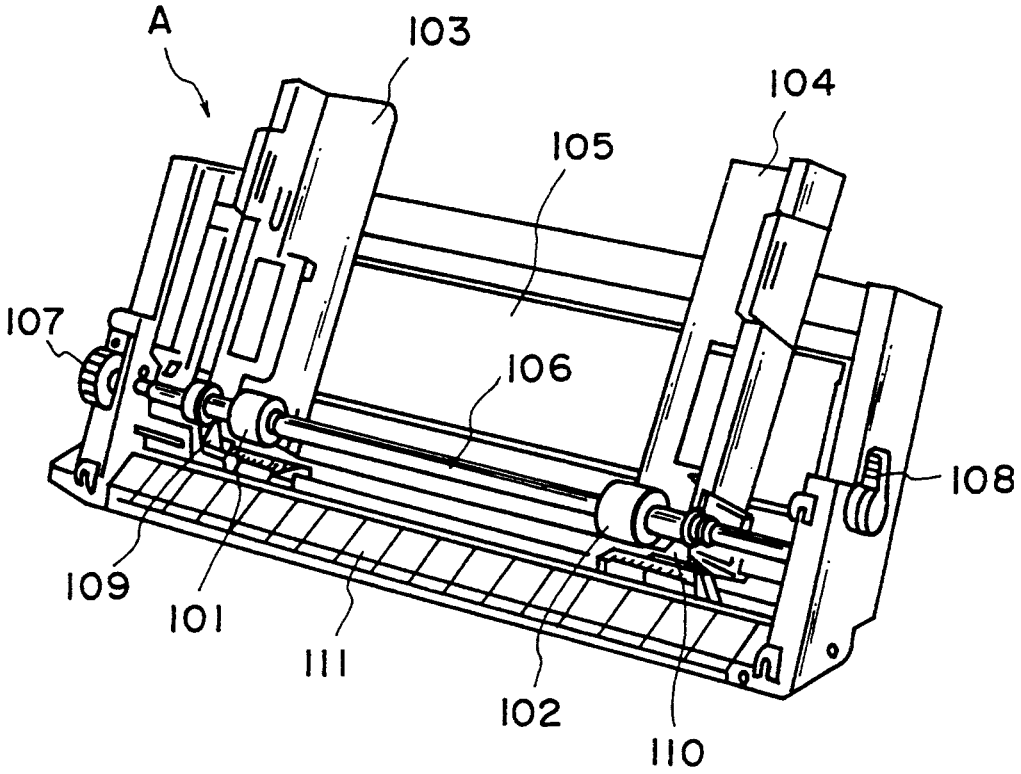
FIG. 12 PRIOR ART
FIG. 12 is a perspective view of the sheet feeding apparatus of FIG. 11.

In the above sixth and seventh embodiments, while the sheet supply roller rubber layers 1*b*, 1*b'* were provided on both sheet supply rollers 1, 1', as shown in FIG. 10, the sheet supply roller 1' remote from the separating claw 5 may have no sheet supply roller rubber layer 1*b'*.

In this case, the surface of the sheet supply roller 1' is provided with the serration or indentation to provide the stable coefficient of friction. When the sheet supply roller 1' is made of resin material such as ABS (acrylonitrile butadiene styrene resin) or PS (polystyrene), the coefficient of friction between the surface of the sheet supply roller 1' and the high class paper sheet becomes smaller than those of the above-mentioned EPDM or other rubber materials. Accordingly, the sheet feeding force of the sheet supply roller 1 near the separating claw 5 can be greater than that of the sheet supply roller 1', as in the previous embodiments.

In this case, since the sheet supply roller rubber layer 1*b'* can be omitted, it is possible to facilitate the assembling operation and make the apparatus inexpensive. The other arrangements are the same as those in the aforementioned embodiments.

As mentioned above, according to the present invention, the following advantages can be obtained.

(1) To cope with various sheets having different widths, since there is no need to slide the separating claw, sheet supply rollers and the like together with the movable guide, the number of parts can be reduced, thus making the apparatus inexpensive.

(2) Since the construction is simple, the space effect can easily be improved, thus making the apparatus small sized.

(3) Since the construction is simple, the reliability of the apparatus can be enhanced.

(4) The sheet feeding force of the sheet supply roller near the separating claw becomes greater than that of the other sheet supply roller by increasing the urging force of the sheet supply roller near the separating claw against the sheet greater than that of the other sheet supply roller. With this arrangement, it is possible to separate the sheet more effectively by means of the separating claw and to feed the sheet without the skew-feed of the sheet.

Incidentally, in the illustrated embodiments, while the ink jet recording system was explained as a recording system to which the sheet feeding apparatus of the invention was connected, the sheet feeding apparatus of the present invention may be connected to a wire dot recording system, a thermal recording system or an electrophotographic recording system.

Further, in the illustrated embodiments, while the sheet feeding apparatus was detachably connected to the recording system, the sheet feeding apparatus of the present invention may be bodily incorporated into the recording system.

Further, in the illustrated embodiments, while the separating claw was explained as the separating means, a friction separating means comprising a separation roller and a friction member or other separating means may be used.

What is claimed is:

1. A sheet feeding apparatus, comprising:

sheet supporting means for supporting sheets thereon;

a plurality of rotary sheet supply means for feeding out the sheets from said sheet supporting means by sheet feeding force;

separating means for separating the sheets one by one by regulating a front corner of a sheet to be fed out by said plurality of rotary sheet supply means; and a pair of guide members for regulating both lateral edges of the sheets supported by said sheet supporting means, wherein one guide member of said pair of guide members is located near said separating means and is fixed and the other one guide member of said pair of guide members is movable in accordance with the sizes of the sheets, wherein a sheet feeding force of one of said plurality of rotary sheet supply means located closest to said separating means is greater than a sheet feeding force of the remainder of said plurality of rotary sheet supply means.

2. A sheet feeding apparatus according to claim 1, wherein coefficients of friction of said plurality of rotary sheet supply means and the sheets increase with proximity to said separating means.

3. A sheet feeding apparatus according to claim 2, wherein the coefficients of friction of said rotary sheet supply means are differentiated by changing materials forming portions of said rotary sheet supply means which are contacted with the sheet.

4. A sheet feeding apparatus according to claim 2, wherein the coefficients of friction of said rotary sheet supply means are differentiated by changing hardness of portions of said rotary sheet supply means which are contacted with the sheet.

5. A sheet feeding apparatus according to claim 2, wherein the coefficients of friction of said rotary sheet supply means are differentiated by changing roughness of portions of said rotary sheet supply means which are contacted with the sheet.

6. A sheet feeding apparatus according to claim 1, wherein contact areas of said plurality of rotary sheet supply means and the sheets increases with proximity to said separating means.

7. A sheet feeding apparatus according to claim 1, wherein said sheet supporting means comprises a biasing means for biasing the sheets supported by said sheet supporting means toward said plurality of rotary sheet supply means.

8. A sheet feeding apparatus according to claim 7, wherein said sheet supporting means further comprises a plate for supporting the sheets.

9. A sheet feeding apparatus according to claim 8, wherein said biasing means is disposed alone near said separating means, thereby applying the greater biasing force to said rotary sheet supply means near said separating means to generate the greater sheet feeding force, and applying the smaller biasing force to said rotary sheet supply means remote from said separating means to generate the smaller sheet feeding force.

10. A sheet feeding apparatus according to claim 8, wherein said biasing means is disposed alone in confronting relation to said rotary sheet supply means near said separating means, thereby applying the greater biasing force to said rotary sheet supply means near said separating means to generate the greater sheet feeding force, and applying the smaller biasing force to said rotary sheet supply means remote from said separating means to generate the smaller sheet feeding force.

11. A sheet feeding apparatus according to claim 8, wherein a plurality of biasing means are disposed in confronting relation to said plurality of rotary sheet supply means, respectively, wherein a biasing force of one of said plurality of biasing means disposed in confronting relation to a corresponding one of said plurality of rotary sheet supply means located closest to said separating means is greater to generate a greater sheet feeding force than a biasing force of one of said plurality of biasing means disposed in confronting relation to one of said plurality of rotary sheet supply means located away from said separating means.

12. A sheet feeding apparatus according to claim 8, wherein said biasing means comprises a coil spring.

13. A sheet feeding apparatus according to claim 1, wherein said separating means comprises a separating claw for regulating the front corner of a sheet to be separated forwardly and upwardly so that the sheet to be separated is separated from other sheets when the sheet to be separated rides over said separating claw.

14. A sheet feeding apparatus according to claim 1, wherein said plurality of rotary sheet supply means comprise sheet supply rollers.

15. A recording system comprising:

sheet supporting means for supporting sheets thereon;

a plurality of rotary sheet supply means for feeding out the sheets from said sheet supporting means by sheet feeding force;

separating means for separating the sheets one by one by regulating a front corner of a sheet to be fed out by said plurality of rotary sheet supply means;

a pair of guide members for regulating both lateral edges of the sheets supported by said sheet supporting means, wherein one guide member of said pair of guide members is located near said separating means and is fixed and the other one guide member of said pair of guide members is movable in accordance with the sizes of the sheets; and recording means for recording an image on the sheet separated by said separating means wherein a sheet feeding force of one of said plurality of rotary sheet supply means located closest to said separating means is greater than a sheet feeding force of the remainder of said plurality of rotary sheet supply means.

16. A recording system according to claim 15, wherein coefficients of friction of said plurality of rotary sheet supply means and the sheets increase with proximity to said separating means.

17. A recording system according to claim 15, wherein said sheet supporting means comprises a biasing means for biasing the sheets supported by said sheet supporting means toward said plurality of rotary sheet supply means.

18. A recording system according to claim 15, wherein said recording means comprises an ink jet type printer in which the image is recorded by discharging ink by utilizing a change in pressure from growth and contraction of a bubble caused by a film boiling generated by thermal energy.

19. A sheet feeding apparatus, comprising:

a sheet supporting member for supporting sheets thereon;

a plurality of rotary sheet supply members for feeding out the sheets from said sheet supporting member;

a sheet separating member for separating the sheets one by one by regulating one front corner of the sheets fed out by said rotary sheet supply members;

a pair of guide members for regulating both lateral edges of the sheets supported by said sheet supporting members, wherein one guide member of said pair of guide members is located near said sheet separating member and is fixed and the other one guide member of said pair of guide members is movable in accordance with the sizes of the sheets; and a plurality of biasing members for biasing said sheet supporting member to urge the sheet supported by said sheet supporting member onto said plurality of rotary sheet supply members, wherein an urging force of one of said plurality of biasing members located closest to said sheet separating member is larger than that of the other of said plurality of biasing members.

20. A sheet feeding apparatus according to claim 19, wherein said sheet separating member comprises a separating pawl.

21. A sheet feeding apparatus according to claim 20, wherein said plurality of biasing members comprise coil springs disposed at positions corresponding to said plurality of rotary sheet supply members on the opposite side of the sheets with respect to said sheet supporting member.

22. A recording system, comprising:

a sheet supporting member for supporting sheets thereon;

a plurality of rotary sheet supply members for feeding out the sheets from said sheet supporting member;

a sheet separating member for separating the sheets one by one by regulating a front corner of one of the sheets to be fed out by said plurality of rotary sheet supply members;

a pair of guide members for regulating both lateral edges of the sheets supported by said sheet supporting member, wherein one guide member of said pair of guide members is located near said sheet separating member and is fixed and the one guide member of said pair of guide members is movable in accordance with the sizes of the sheets;

a plurality of biasing members for biasing said sheet supporting member to urge the sheet supported by said sheet supporting member onto said plurality of rotary sheet supply members; and recording means for recording an image on a sheet separated by said sheet separating member;

wherein an urging force of one of said plurality of biasing members located closest to said sheet separating member is larger than the urging force of the other of said plurality of biasing members.

23. A sheet feeding apparatus, comprising:

sheet supporting means for supporting sheets thereon;

guide means for guiding both lateral edges of the sheets supported by said sheet supporting means, said guide means being movable in accordance with the sizes of the sheets;

a plurality of rotary sheet supply means for feeding out the sheets from said sheet supporting means by sheet feeding force; and separating means for separating the sheets one by one by regulating a front corner of the sheets to be fed out by said plurality of rotary sheet supply means;

wherein a sheet feeding force of one of said plurality of rotary sheet supply means located closest to said separating means is greater than a sheet feeding force of the remainder of said plurality of rotary sheet supply means so that the sheet separated by said separating means is guided along said guide means straightly.

24. A sheet feeding apparatus according to claim 23, wherein said separating means comprises a separating claw and said guide means comprises a pair of guide members, said separating claw being disposed one of said pair of guide members.

25. A recording system comprising:

sheet supporting means for supporting sheets thereon;

guide means for guiding both lateral edges of the sheets supported by said sheet supporting means, said guide means being movable in accordance with the sizes of the sheets;

a plurality of rotary sheet supply means for feeding out the sheets from said sheet supporting means by sheet feeding force;

separating means for separating the sheets one by one by regulating a front corner of the sheets to be fed out by said plurality of rotary sheet supply means; and recording means for recording an image on the sheet separated by said separating means;

wherein a sheet feeding force of one of said plurality of rotary sheet supply means located closest to said separating means is greater than a sheet feeding force of the remainder of said plurality of rotary sheet supply means so that the sheet separated by said separating means is guided along said guide means straightly.

* * * * *

UNITED STATES PATENT AND TRADEMARK OFFICE

CERTIFICATE OF CORRECTION

PATENT NO. : 5,348,283
DATED : September 20, 1994
INVENTOR(S) : HARUYUKI YANAGI, ET AL.

It is certified that error appears in the above-indentified patent and that said Letters Patent is hereby corrected as shown below:

Column 2,
Line 47, "ms" should read --is--;
Line 50, "ms" should read --is--;
Line 53, "ms" should read --is--; and
Line 56, "ms" should read --is--.

Column 5,
Line 21, "a plurality" should be deleted.

Column 12,
Line 3, "members," should read --member,--.

Signed and Sealed this

Seventh Day of February, 1995

Bruce Lehman

*Attest:*

BRUCE LEHMAN

*Attesting Officer*

*Commissioner of Patents and Trademarks*